United States Patent [19]

Mahoney

[11] Patent Number: 4,920,381

[45] Date of Patent: Apr. 24, 1990

[54] TONER CONTAINER LIFT MECHANISM

[75] Inventor: Gregory P. Mahoney, Fairport, N.Y.

[73] Assignee: Eastman Kodak Company, Rochester, N.Y.

[21] Appl. No.: 293,033

[22] Filed: Jan. 3, 1989

[51] Int. Cl.[5] ..... G03G 15/06

[52] U.S. Cl. ..... 355/260; 118/653

[58] Field of Search ..... 222/DIG. 1, 162, 163, 222/205, 305, 306, 336, 405; 355/260, 296, 298; 118/653; 220/22.1, 22.6; 141/113, 352, 359

[56] References Cited

U.S. PATENT DOCUMENTS

| | | | |
|---|---|---|---|
| 3,539,077 | 11/1970 | Drexler et al. | 222/82 |
| 3,914,460 | 10/1975 | Maksymiak | 118/653 X |
| 4,353,637 | 10/1982 | Parker | 355/3 DD |
| 4,417,802 | 11/1983 | Forbes, II | 355/3 DD |
| 4,500,196 | 2/1985 | Shimura | 355/260 X |
| 4,743,937 | 5/1988 | Martin | 118/653 X |

FOREIGN PATENT DOCUMENTS

| | | | |
|---|---|---|---|
| 0137260 | 6/1988 | Japan | 355/260 |

*Primary Examiner*—A. T. Grimley
*Assistant Examiner*—Robert Beatty
*Attorney, Agent, or Firm*—Tallam I. Nguti

[57] ABSTRACT

A development apparatus in an electrostatographic copier or printer includes a constant force lift mechanism for automatically and gradually lifting a toner container so as to maintain contact between toner in the container and a toner replenishment roller. The mechanism includes a cam and spring assembly consisting of pivotable L-shaped cams that are connected by a horizontal tension spring for automatically lifting and lowering the toner container in response to the weight of toner in the container.

10 Claims, 1 Drawing Sheet

TONER CONTAINER LIFT MECHANISM

BACKGROUND OF THE INVENTION

This invention relates to apparatus in an electrostatographic copier or printer for developing electrostatic images with toner, and more particularly to a mechanism in a space restricted development apparatus for automatically and gradually lifting a toner container in order to maintain contact between toner in the container and means, including a replenishment roller, for transferring the toner to the electrostatic images.

In electrostatographic copiers and printers, electrostatic images, on an insulated image bearing member, such as a photoconductor, are developed, that is, made visible with toner particles. Such development can be carried out with a development apparatus that typically includes a development roller, a toner replenishment roller, and a container for holding the toner particles. The development roller, which rotates about a fixed axis, and spaced from the image bearing member, functions to carry and bring toner particles into transfer contact with electrostatic images on the image bearing member. The toner particles which are precharged, triboelectrically, for example, are supplied to the development roller by the toner replenishment roller. The toner replenishment roller rotates about a fixed axis, and is in contact with the development roller. In addition, the replenishment roller must also rotate in contact with the toner particles being held in the container or sump portion of the development apparatus.

As disclosed, for example, in U.S. Pat. No. 4,353,637, issued Oct. 12, 1982 in the name of Parker, the transfer in electrostatographic copiers and printers, of toner particles from a toner container to electrostatic images on an image bearing member, over time, depletes the quantity of toner particles available in the container. Such depletion eventually will drop the level of toner particles within the container below and out of contact with the means for transferring the toner to electrostatic images. As also disclosed, for example, in this patent, and in U.S. Pat. No. 4,417,802, issued Nov. 29, 1983 in the name of Forbes, mechanisms have therefore been provided for vertically lifting the toner container in order to retain contact between the dropping level of depleting toner in the container and such transfer means. As also disclosed, it is well known to use bellows, pressurized air or vertically acting spring mechanisms, for example, for lifting the toner container in order to achieve such contact.

However, bellows and pressurized air mechanisms are bulky, and at best expensive. In addition, because of design limitations in the relationship between the free length and the available deflection of springs, vertical spring mechanisms often require a lot of vertical space to operate, and therefore may not be able to function effectively within a height restricted environment. Furthermore, vertical springs usually are susceptible to buckling failure.

SUMMARY OF THE INVENTION

It is an object of the present invention to provide a simple, low cost and inexpensive toner container lift mechanism for automatically lifting and lowering the toner container of a development apparatus in an electrostatographic copier or printer, in response to changes in the weight of toner in the container.

It is another object of the present invention to provide a toner container lift mechanism suitable for use effectively in a height restricted environment in such a development apparatus.

It is a further object of the present invention to provide a toner container lift mechanism that exerts a substantially constant force on the toner container throughout a given lift distance.

In accordance with the present invention, the development apparatus of an electrostatographic copier or printer includes a cam and spring assembly for supporting, and for automatically lifting and lowering a toner container in response to changes in the weight of toner in the container. The cam and spring assembly includes a pivotable cam with at least one flat side, as well as, a horizontal spring that is connected to the cam. The spring operates to resist the pivoting movement of the cam, as well as, to return the cam after it has moved in response to changes in the quantity of toner in the container.

The particular cam and spring assembly mechanism of the present invention is suitable for use in height restricted environments. It is simple and inexpensive, and it substantially maintains a constant lifting force on the toner container throughout the lift distance. Other aspects and advantages of the mechanism of the present invention will become more apparent from the following drawing and detailed description.

BRIEF DESCRIPTION OF THE DRAWING

In the detailed description of the preferred embodiment of the invention presented below, reference is made to the accompanying drawing, in which:

The figure is a side sectional view of part of a development apparatus in an electrostatographic copier or printer including the cam and spring assembly lift mechanism of the present invention.

DETAILED DESCRIPTION OF THE PREFERRED EMBODIMENT

Figure 1:
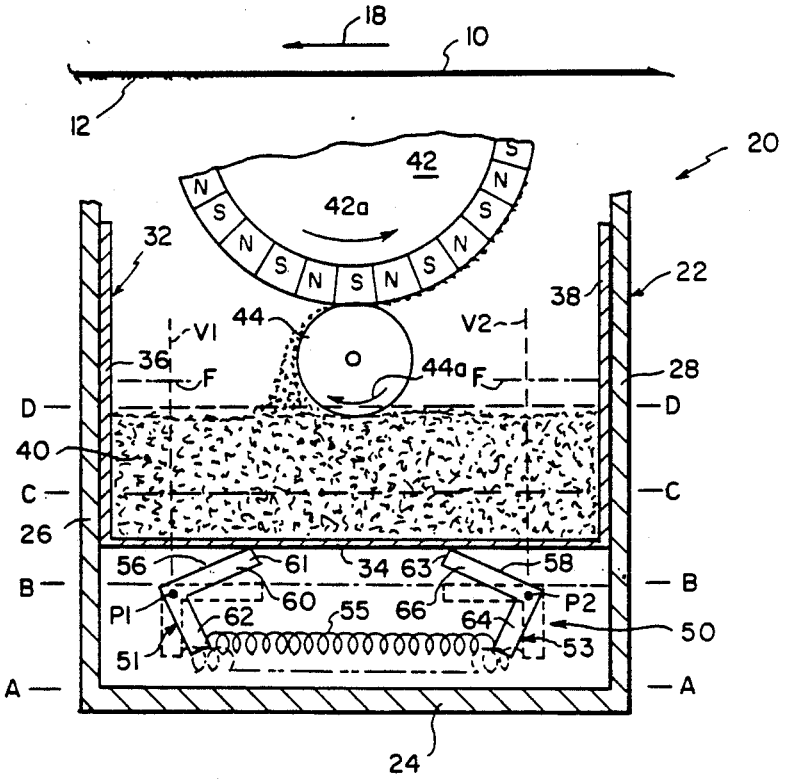

Referring to the drawing, it shows a part of a development apparatus 20. For developing electrostatic images 12 on an image bearing member 10 being moved, for example, in the direction of the arrow 18, in an electrostatographic copier or printer. The development apparatus 20 includes a housing 22 that may be fixed to the support frame of the copier or printer. The housing 22 has a base 24, side walls 26, 28, and a back wall (not shown). In addition, housing 22 may have an open front end for providing front access into the housing.

Inside the housing 22, a container 32, which has a base 34 and side walls 36, 38, is located and adapted to move up and down on the side walls 26, 28 of the housing. The container 32, which also includes end walls (not shown), is suitable for holding toner particles 40, and can be moved so that its bottom 34 goes from a lowered position along the line B—B, to a fully raised position, for example, along the line C—C. When the container 32 is full of toner, the toner will occupy it, for example, to a level F. The level F is chosen so as to maximize the quantity of toner 40 that the container 32 can hold. Since the housing 22 includes an open front end, the container 32 may come in the form of a cartridge, prefilled with toner to the level F, and ready for front to back loading into the housing 22.

Development apparatus 20 further includes a development roller 42 that is rotatable about a fixed axis in the direction of the arrow 42A, for example. Development roller 42, which rotates as such, and is spaced from the image bearing member 10, includes a series of magnets on its periphery for carrying and bringing charged toner into transfer contact with the electrostatic latent images 12 on the image bearing member 10. As shown, the charged toner 40 is supplied to the development roller 42 by a toner replenishment roller 44. Roller 44, which may include brush type bristles for carrying the toner, rotates about a fixed axis in the direction of the arrow 44A, as well as, in contact with the development roller 42. In addition, roller 44 must also rotate in contact with the toner 40 within the container 32.

Rotation of the roller 44, as indicated, in the direction of the arrow 44A, will contact and carry toner from the container into transfer contact with the development roller 42. The roller 42 in turn will carry the toner into transfer contact with electrostatic latent images on the image bearing member 10, where the toner is attracted and held making the electrostatic images visible. Such transfer of toner, of course, depletes the quantity of toner within the container 32, therefore tending to cause the level of toner remaining in the container to drop below, and out of contact with the roller 44. As a result, since the roller 44 rotates about a fixed axis, the container 32 must be moved upwards towards the roller 44 in order to maintain the desired transfer contact between the roller 44 and the depleting level of toner within the container 32.

Development apparatus 20 therefore includes a mechanism, generally designated 50, for supporting, and for automatically lifting and lowering the container 32 in order to maintain the desired transfer contact with the replenishment roller 44. The mechanism 50, as shown, is located in the housing 22 underneath the container 32, within a restricted space shown as having a height AB. The height AB is made as minimal as possible in order to maximize the distance BD between mechanism 50 and roller 44, and hence to maximize the quantity of toner 40 in a full container 32. The mechanism 50 must be such that when the container 32 is filled with toner 40 to the level F, the mechanism 50 will support the bottom of the container 32 in its lowered position along B—B such that the toner at the level F just makes contact with the roller 44.

The mechanism 50 consists essentially of a cam and spring assembly, in which a pair of cams 51, 53, are connected by a spring 55. The cams 51, 53, which can be made inexpensively from a plastic material, are supported pivotably about fixed axes P1, P2, respectively. Axes P1, P2 are spaced and centered between the walls 26, 28. The means of such axial support, for example a shaft, must be strong enough to enable the cams to safely support the weight of the container 32 when it is full of toner. As illustrated, each cam 51, 53 has at least one flat side 56, 58, respectively.

As supported about the axis P1, cam 51, for example, is capable of resting at a lowered position along the line B—B In this lowered position, the flat side 56 of cam 51, is essentially horizontal to the line B—B, and can fully contact and support the flat bottom 34 of the container 32. From the position along B—B, the cam 51 can be pivoted upwards, and variably about P1, until the distal end 61 of the flat side 56 reaches or is close to a fully raised position along the line C—C. At such a raised position, however, the flat side 56 is preferably short of the vertical V1 in order to insure that the cam 51, if loaded at the distal end 61 of such flat side, will reverse its pivotal movement, rather than continue its upwards pivotal movement. The cam 53 as supported about the axis, P2 exactly mirrors the operation of cam 51 with respect to its pivoting movements between a lowered position along the line B—B (shown in phantom) to a raised position along the line C—C.

Although there is initially full contact between the flat sides 56, 58 of the cams 51, 53 respectively, and the flat bottom 34 of the container 32 when all are at their lowered positions along the line B—B, such contact decreases as the flat sides 56, 58 of the cams pivot from the lowered to the raised positions, while lifting the container 32 with them. As such contact decreases, the effective point of concentration of the downward weight of toner in the container 32, on the cams 51, 53, gradually shifts away from close to the pivot points P1, P2, towards the distal ends 61, 63 of the flat sides 56, 58 respectively. As shown, each cam 51, 53 can be L-shaped, thereby consisting of first portions 60, 66 and second portions 62, 64, respectively such that, as clearly shown in the drawing, the first portion of each cam is longer than its second portion. As such, each first and second portions are connected at an elbow through, and along which run the axes P1, P2. The outside surfaces of the first portions 60, 66 form the flat sides 56, 58.

The spring 55 is connected to each cam 51, 53 at a fixed point that is below the pivot and support axes P1, P2, and preferably diagonally across from the distal end of each flat side 56, 58. As shown, such connection can be suitably made at the distal ends of the second portions 62, 64 of the L-shaped cams. When a pair of cams is utilized, as shown, the cams are connected to each other by the spring 55. A single cam, of course, can be employed in which case the spring 55 will be connected to the cam as described, and then to an appropriate point on side wall 26 or 28.

The spring 55, which may be a cylindrical helical spring of circular cross-section, can be made of stainless steel wire. Because of buckling problems associated with unsupported compression springs, spring 55 is preferably an unsupported tension spring, and its free length should be such that the spring, when connected as described above, experiences zero deflection with the cam or cams in their fully raised positions along the line C—C. For example, the spring 55 will have zero deflection when the second portions 62, 64 of the cams 51, 53, are pulled toward each other, while the first portions 60, 66 are in their fully raised positions along C—C. In addition, the spring 55 should be made so as to have an available deflection sufficient to enable the first portions 60, 66 of the cams 51, 53 to be lowered pivotably from their fully raised positions along C—C, down to their lowered and horizontal positions along the line B—B.

Most importantly, spring 55 should be made so that its load characteristics are such that the weight of the container 32, when filled with toner 40 to the level F, is sufficient to fully load and fully deflect the spring 55. Filling the container 32 to the level F with toner, should therefore lower the distal ends 61, 63 of the flat sides 56, 58, from their fully raised positions along C—C, to their lowered, horizontal positions along B—B while loading and fully deflecting the spring 55 in the process.

Deflected as such, spring 55 of course will act to exert constant inward forces, for example, on the second portions 62, 64 of the cams 51, 53, respectively. Such inward forces result in a pivoting tendency of the cams 51, 53, about the axes P1, P2, and hence also in a pivoting tendency of the first portions 60, 66, upwards. The portions 60, 66 therefore push upwardly against the weight of toner in the container 32.

The load characteristics of the spring 55, as described above, should also be such that this upward pushing imparted to the portions 60, 66, is just equal to the weight of toner in the container 32, when the portions 60, 66 are in their lowered positions along B—B. In addition, the load characteristics of the spring 55, for example, the spring rate, should be such that, as the quantity of toner in the container 32 is depleted over time by continued transfer to electrostatic latent images on the member 10, the upward pushing imparted to the portions 60, 66 remains constant, and therefore proportionally becomes greater and greater than the weight of the remaining quantity of toner in the container. The result, of course, is a constant, gradual and proportional lifting of the container 32 in direct response to the degree of depletion or reduction of the quantity of toner in the container. Although the lifting force imparted to the portions 60, 66 becomes greater than the weight of the depleting toner in the container 32, the force on the container is constant because the lifting force acts at a fixed point relative to the pivot points P1, P2, but the decreasing weight of toner gradually acts effectively at an increasing distance from the pivots P1, P2. As a result, the momentums created about the pivots P1, P2 are equalized gradually as the point of contact between the bottom of the container 32 and the portions 60, 66 move away from pivot points P1, P2 towards the distal ends 61, 63 of the flat sides 56, 58.

When the container 32 is so depleted of toner such that the portions 60, 66 are at their fully raised positions, the container 32 (now essentially empty) can be refilled with precharged toner from a refill source, such as a toner bottle. As such new toner is being added to the container 32, the additional weight of toner pushes down on the portions 60, 66, counteracting their upwardly pushing forces, and thereby loading the spring 55 toward full deflection. A quantity of toner sufficient to refill the container 32 to the level F, can be added. Doing so should automatically lower the portions 60, 66 to their lowered positions along B—B while fully deflecting the spring 55.

The outside corners of the distal ends 61, 63 of each first portion 60, 66 is preferably rounded so as to provide a rotatable surface for contact with the bottom 34, when such contact finally shifts to that area of the flat side 56, 58. One advantage of this shifting of the contact point is that there is substantially no change in the force pushing the toner in the container against the roller 44, as the portions 60, 66 pivot from B—B to C—C. In order to insure such constancy in the upward forces in portions 60, 66, the spring 55 should be selected so that the given travel of the toner container from B—B to C—C is achieved with a minimal deflection of the spring, for example, a deflection that is only about 10 percent of the free length of the spring.

Although the illustrated embodiment of the mechanism of the present invention shows and describes a pair of cams, 51, 53, it should be noted that a single cam can also be employed. The single cam, for example, can be identical to cam 51. It also can be made out of a plastic material, but it will be located such that, lowered or raised, it will tend to contact and support the center of the bottom 34 of the container 32. The tension spring 55 will be connected, for example, to the second portion 62, and then to the opposite wall 28 of the housing 22. When so connected, such a single cam will operate to lift and lower the container 32 between the levels B—B and C—C in much the same way as the pair of cams 51, 53, responding, of course, to the depletion and addition of toner in the container 32.

Whether using a single cam or a pair of cams, it is clear that the mechanism of the present invention is simple, low cost and less expensive than mechanisms employing bellows or pressurized air. Because it employs a horizontal tension spring, it is particularly suitable for use in height restricted spaces, and is not subject to buckling failure. In addition, the flat side, for example 56 of the cam 51 has a profile which causes the contact point between the cam 51 and toner container 32 to move away from the pivot point P1 as the weight of toner in the container decreases, results in a gradual and desirably constant force pushing the toner in the container 32 against the replenishment roller 44.

Although the invention has been described in detail with particular reference to preferred embodiments, it should be noted that other variations and modifications can be effected within its scope and spirit.

What is claimed is:

1. In an electrostatographic copier or printer wherein electrostatic latent images on an image bearing member are developed with toner, a development apparatus having an upward and downward movable flat bottom container for holding a quantity of toner, the improvement comprising a cam and spring assembly for supporting, and for automatically and gradually (a) lowering the toner container from a raised position to a lowered position in response to toner being added into the container, and (b) lifting the container from such lowered position upwards to the raised position so as to maintain contact between toner in the container and the means for carrying such toner into transfer contact with the electrostatic image, said cam and spring assembly including a pivotable L-shaped cam having at least one flat side and a horizontal spring connected to said cam for automatically resisting the pivoting movement of said cam when moved from the raised position to the lowered position by the addition of toner to the container, and for automatically returning said cam from the lowered position to the raised position in response to the depletion of toner in the container.

2. The invention of claim 1 wherein said flat side of said cam fully contacts and supports the flat bottom of the container when the container is filled with toner and both the cam and container are in said lowered position.

3. The invention of claim 1 wherein said spring is a horizontal tension spring having a predetermined free length, and is capable of an elastic deflection sufficient to enable said cam to pivot from said raised position to said lowered position.

4. The invention of claim 1 wherein said spring assembly includes a pair of said pivotable cams.

5. The invention of claim 3 wherein the free length and the available deflection of said spring have a ratio of about 10 to 1.4.

6. The invention of claim 4 wherein said pair of pivotable cams are located spaced one from he other, and are interconnected with said spring such that the spring has a zero deflection when the cams are fully pivoted upwards to their raised position.

7. A mechanism for lifting and lowering a toner container in an electrostatographic development apparatus, the mechanism comprising:

(a) a pair of pivotable cams mounted spaced apart for supporting the toner container, said pair of cams having a raised position and a lowered position, and each said cam having (i) a first portion including a first distal end and a flat side for contacting the toner container, and (ii) a second portion including a second distal end, said first and second portions of each said cam forming an elbow, and each said cam including a pivot point at each said elbow respectively; and (b) a horizontal spring for automatically lifting said pair of cams to said raised position thereby automatically lifting the toner container therewith, said spring being connected to each said cam at said second distal end directly below said pivot point thereof, and said spring, as connected, cooperating with said flatsides of said cams to automatically lift and lower the toner container throughout with a constant momentum.

8. The mechanism of claim 7 wherein said raised position of said pair of cams is just short of a vertical orientation in order to allow for automatic reversal of the upwardly spring induced pivotal movement of said cams, when the toner container is being filled with toner.

9. The mechanism of claim 7 wherein said first portion of each said cam is longer than said second portion respectively.

10. The mechanism of claim 7 wherein said spring is a horizontally acting tension spring having a free length to available deflection ratio of 10:1, and a zero deflection when said pair of connected cams are in said raised position.

* * * * *